United States Patent [19]

Koshizuka et al.

[11] Patent Number: 4,752,534

[45] Date of Patent: Jun. 21, 1988

[54] THERMAL TRANSFER RECORDING MEDIUM

[75] Inventors: Kunihiro Koshizuka; Shigehiro Kitamura; Takao Abe, all of Hino, Japan

[73] Assignee: Konishiroku Photo Industry Co., Ltd., Tokyo, Japan

[21] Appl. No.: 81,321

[22] Filed: Aug. 3, 1987

[30] Foreign Application Priority Data

Aug. 8, 1986 [JP] Japan ..... 61-187172
Aug. 18, 1986 [JP] Japan ..... 61-192601

[51] Int. Cl.[4] ..... B41M 5/26

[52] U.S. Cl. ..... 428/500; 428/195; 428/207; 428/211; 428/483; 428/484; 428/488.1; 428/511; 428/913; 428/914

[58] Field of Search ..... 428/195, 484, 488.1, 428/488.4, 913, 914, 483, 500, 511

[56] References Cited

FOREIGN PATENT DOCUMENTS 3510233 10/1985 Fed. Rep. of Germany ... 428/488.1
3515028 10/1985 Fed. Rep. of Germany ... 428/488.1
225794 11/1985 Japan ..... 428/488.1

*Primary Examiner*—John E. Kittle
*Assistant Examiner*—P. R. Schwartz
*Attorney, Agent, or Firm*—Frishauf, Holtz, Goodman & Woodward

[57] ABSTRACT

There is disclosed a thermal transfer recording medium having a colorant layer containing a heat-fusible substance and a colorant formed on a support, the colorant comprising a copolymer obtained from an ethylene, an acrylic acid derivative represented by the formula (I):

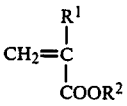

(I)

wherein $R^1$ represents a hydrogen atom or a methyl group and $R^2$ represents a straight or branched alkyl group having 1 to 8 carbon atoms, and a maleic anhydride, and may further contain polyoxyethylene type compound.

14 Claims, No Drawings

THERMAL TRANSFER RECORDING MEDIUM

BACKGROUND OF THE INVENTION

This invention relates to a thermal (heat-sensitive) transfer recording medium, more particularly to a thermal transfer recording medium capable of printing with high transfer sensitivity and with low energy, and also inhibiting generation of ground contamination (fog) on a recording sheet such as low smoothness paper and giving a dye transferred image with excellent fixability on a recording sheet and also high resolving power.

Thermal transfer recording medium has been used in the prior art as a recording medium for forming by transfer an image on a recording sheet such as plain paper by a thermal printer or a thermal facsimile.

Such a thermal transfer recording medium has at least one colorant layer on a support. As the colorant layer, there have been known layers containing colorants comprising dyes such as pigments and heat-fusible substances which are low melting substances such as waxes. Also, as the support, for obtaining good reproducibility of the dye transferred image obtained from the colorant layer coated thereon, films excellent in surface smoothness and dimensional stability have been used.

The thermal transfer recording medium of this kind in the prior art has been variously devised and proposed so as to effect transfer printed images sharply with good fixability onto the recording sheet with a smooth surface.

However, at the present time, it has been strongly demanded to have a thermal transfer recording medium which can also effect good transfer of printed images onto the so-called low smoothness surface which is not necessarily smooth on the surface.

For, in the case of performing, for example, a trial printing of a document by a thermal printer having a thermal head, it is not necessary at all to use an expensive smooth paper, but rather an inexpensive recording sheet with low smoothness may be desirably employed, and it is frequently practiced to use the back surface (this surface is usually a rough surface) of a plain paper of which a printed image is printed on the front surface, but has now become unnecessary. Also, for prevention of forgery of documents, or for making avail of the specific feature of the address of the documents, it is sometimes necessary to transfer the printed images onto a recording sheet which has been intentionally made to have low smoothness surface. Besides, it is not only sufficient that printed images can be anyhow transferred onto low smoothness surface, but it has been increasingly required to form printed images onto a recording sheet of which surface is specially made rough with a thermal transfer recording medium with high transfer sensitivity, low energy, without generation of ground contamination (fog), and with good fixability and high resolving power.

In spite of such demands, various inventions and utility models concerning the ink layers in thermal transfer recording medium have been in most cases directed to plain papers with smooth surface, and it is not too much to say that substantially no thermal transfer recording medium has been proposed provided with an ink layer satisfying all of the increasing requirements as mentioned above.

SUMMARY OF THE INVENTION

An object of the present invention is to provide a thermal transfer recording medium capable of forming a printed image not only on a smooth surface but also on a surface with low smoothness with high transfer sensitivity and yet with low energy.

Another object of the present invention is to provide a thermal transfer recording medium capable of forming a printed image of high resolving power and high printing quality with good fixability not only on a smooth surface but also on a surface with low smoothness while further suppressing generation of fog.

Still another object of the present invention is to provide a thermal transfer recording medium capable of further alleviating the load given to the printer side of, for example, a wine-up torque.

The gist of the present invention in order to accomplish the above objects is a thermal transfer recording medium having a colorant layer containing a heat-fusible substance and a colorant formed on a support, said colorant layer comprising a copolymer obtained from an ethylene, an acrylic acid derivative represented by the formula (I):

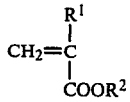

(I)

wherein $R^1$ represents a hydrogen atom or a methyl group and $R^2$ represents a straight or branched alkyl group having 1 to 8 carbon atoms, and a maleic anhydride.

As the result of intensive studies by the present inventors in order to accomplish the above objects, the present inventors have found that, in a thermal transfer recording medium having (1) a colorant layer containing a heat-fusible substance and (2) a coloring material on a support, by formulating a specific combination of a copolymer of specific compounds and a polyoxyethylene compound in the above colorant layer, the above objects can be accomplished, to reach the present invention.

More specifically, the gist of the present invention in order to accomplish the present invention is a thermal transfer recording medium having a colorant layer containing a heat-fusible substance and a colorant formed on a support, said colorant layer comprising a copolymer obtained from an ethylene, an acrylic acid derivative represented by the formula (I):

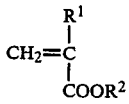

(I)

wherein $R^1$ represents a hydrogen atom or a methyl group and $R^2$ represents a straight or branched alkyl group having 1 to 8 carbon atoms, and a maleic anhydride, and a polyoxyethylene type compound.

DESCRIPTION OF THE PREFERRED EMBODIMENTS

Copolymer

The above copolymer can be represented by the following formula (II):

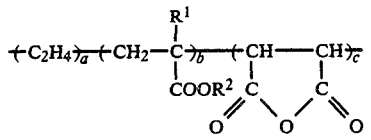

(II)

In the formula (II), $R^1$ represents a hydrogen atom or a methyl group.

$R^2$ represents a straight or branched alkyl group having 1 to 8 carbon atoms, including, for example, a methyl group, an ethyl group, an n-propyl group, an isopropyl group, a butyl group, an isobutyl group, a t-butyl group, a pentyl group, a hexyl group, a heptyl group and an octyl group.

The above a, b and c represent copolymerization ratios. Among them, when a, b and c are made 100% as the total, the above a is 50 to 90%, preferably 79 to 62%, the above b is 10 to 50%, preferably 20 to 35%, and c is 0.5 to 15%, preferably 0.5 to 10%.

Specific examples of such copolymers represented by the formula (II) may include ethylene-ethyl acrylate-maleic anhydride copolymer, ethylene-propyl acrylate-maleic anhydride copolymer, ethylene-n-butyl acrylate-maleic anhydride copolymer, ethylene-iso-butyl acrylate-maleic anhydride copolymer, ethylene-pentyl acrylate-maleic anhydride copolymer, ethylene-hexyl acrylate-maleic anhydride copolymer, ethylene-octyl acrylate-maleic anhydride copolymer, and the like, and ethylene ethyl methacrylate-maleic anhydride copolymer, ethylene-propyl methacrylate-maleic anhydride copolymer, ethylene-n-butyl methacrylate-maleic anhydride copolymer, ethylene-isobutyl methacrylate-maleic anhydride copolymer, ethylene-pentyl methacrylate-maleic anhydrice copolymer, ethylene-hexyl methacrylate-maleic anhydride copolymer, ethylene-octyl methacrylate-maleic anhydride copolymer and the like.

Further, copolymers in which a part of maleic anhydride in the above copolymers are hydrolyzed to become maleic acid monomers, and copolymers obtained by copolymerization of ethylene, alkyl acrylate and/or alkyl methacrylate each having alkyl group with 1 to 8 carbon atoms and maleic acid can be also included within the copolymers in the present invention.

In short, the copolymer may be any one obtained according to any method, provided that it can be prepared from ethylene, an acrylic acid derivative and maleic anhydride. For example, there may be included copolymers obtained by the simultaneous reaction of ethylene, an acrylic acid derivative and maleic anhydride, and also copolymers obtained by copolymerization of a binary copolymer obtained by previous copolymerization of either two kinds of ethylene, an acrylic acid derivative and maleic anhydride with the remainder of the monomers can be included within the copolymers in the present invention.

However, preferable copolymers in the present invention have a Vicat softening point (according to ASTM D 1525) of 30° C. to 200° C., an elongation at break (according to JIS K 6301) of 200% or more and a strength at break (JIS K 6301) of 30 kg/cm$^2$ or more. It is preferable to select suitably from among the various copolymers as mentioned above, provided that they have such properties.

Only single kind of the above various copolymers may be used, or alternatively two or more copolymers may be used in combination. Further, this copolymer may be used as a blend with other known resins.

Among such various copolymers, those having a softening point (ring and ball method) of 200° C. or lower, particularly within the range from 30° to 200° C., are preferred. Further, resins having a melt flow index (MI) during melting of 1 to 400 g/10 min., further 1 to 50 g/10 min., particularly 1.5 to 40 g/10 min., are preferred.

Such copolymers are commercially available as, for example:

"BONDINE HX-8140" [produced by Sumitomo CDF K.K., MI=20];
"BONDINE AX-8040" [produced by Sumitomo CDF K.K., MI=4.5];
"BONDINE HX-8020" [produced by Sumitomo CDF K.K., MI=10];
"BONDINE HX-8060" [produced by Sumitomo CDF K.K., MI=10];
"BONDINE HX-8290" [produced by Sumitomo CDF K.K., MI=65];
"BONDINE HX-8210" [produced by Sumitomo CDF K.K., MI=200];
"NUC-ACE GA-003" [produced by Nippon Unicar K.K., MI=1.7];
"NUC-ACE GA-004" [produced by Nippon Unicar K.K., MI=1.8];
"NUC-ACE GA-201" [produced by Nippon Unicar K.K., MI=5.0];
"NUC-ACE GA-301" [produced by Nippon Unicar K.K., MI=4.0]; etc.

Polyoxyethylene Type Compound

Next, the above polyoxyethylene type compound is not particularly limited, provided that it is a compound having a moiety represented by the following formula in the molecule:

$$\text{-}(CH_2CH_2O)_n\text{-} \quad \text{(III)}$$

wherein n is an integer of 2 or more, preferably an integer of 4 to 50.

However, the polyethylene type compound is more preferably one having both terminal ends in the form of derivatives rather than in the form of —OH. For example, derivatives of various bonding modes, typically ether bonds, ester bonds or other bonds with a sulfur atom or a nitrogen atom, urethane bonds, etc. formed by the reaction of one or two alcoholic hydroxyl groups of polyethylene glycol with various organic compounds may be included. The bonding form is not particularly essential in the present invention and therefore not particularly limited.

Adequate derivatization should be done based rather on molecular design with respect to molecular weight, miscibility with the heat-fusible substance and number of polar groups so as to achieve optimization for blocking performance, prevention of bleed-out, cohesive force and viscosity. A preferable derivatization may be ether derivatization. This is because a colorant layer containing an ether derivatized polyoxyethylene compound has generally excellent in blocking performance.

Anyway, polyoxyethylene type compounds which can be used in the present invention should be preferably substances which are in the state of solid state or semi-solid state with their melting points or softening points being 30° to 120° C., particularly 40° to 100° C.

Also, when the compound has a plural number of polyoxyethylene chains represented by the formula (III) in the molecule, the total of the molecular weights of the polyoxyethylene chain moieties represented by the above formula (III) may sometimes have a great influence on the effect of the present invention.

Preferable molecular weight of the polyoxyethylene chain moiety represented by the above formula (III) may depend on the molecular weight of the compound as a whole or the structure or the molecular weight of the portion other than the above polyoxyethylene moiety, but may be preferably, in most cases, 40 to 20000, particularly 40 to 2000.

Polyexyethylene type compounds having such molecular weights can be exemplified by various compounds shown below.

(1) Mono- or diester derivatives of polyethylene glycol:

Those belonging to this category may include derivatives esterified with fatty acids having 8 to 50 carbon atoms, such as mono- or diglycolic esters of polyethylene glycol with (a) straight monoene acids, (b) polyene acids such as diene acid, triene acid and tetraene acid, (c) synthetic fatty acids and natural fatty acids, (d) secondary fatty acids and tertiary fatty acids, (e) straight fatty acids and branched fatty acids, (f) dimer acids, (g) polybasic acids such as dibasic acids and acid basic acids, (h) oxycarboxylic acids, (i) fatty acid chlorides, (j) fatty acid anhydrides, and (k) other compounds having single or a plural number of carboxyl groups in the molecule, etc.

Among them, preferred are fatty acids having about 8 to 30 carbon atoms such as caprylic acid, undecanoic acid, lauric acid, tridecanoic acid, myristic acid, pentadecanoic acid, palmitic acid, margaric acid, stearic acid, octacoic acid, merysic acid, etc, particularly mono- or diesters of polyethylene glycol ester with monocarboxylic acids such as nonadecanoic acic, arachic acid, heneicosanoic acid, behenic acid, brassidic acid, tricosaic acid, lignoceric acid, pentacosaic acid, etc.

Polyethylene glycol, as compared with polyethylene monoester, exhibits better dispersing characteristic in the colorant layer composition, and also has the excellent effect of not deteriorating dispersibility of the colorant, and is further excellent in the point that printed image with higher density can be transferred stably on a recording sheet having low surface smoothness. Accordingly, various polyethylene glycol diesters of fatty acids as mentioned above can be pointed out as preferable polyoxyethylene type compounds in the present invention.

In the case of a diester, the two polyoxyethylene chains bonded through ester linkages to the two carboxylic acids may have the molecular weights or structures, which may be either the same or different from each other.

Specific examples of the above diesters may include polyethylene glycol distearate [PEG 4000], polyethylene glycol dibehenate [PEG 14000], polyethylene glycol dipalmitate [PEG 600], polyethylene glycol dilaurate [PEG 100 (all trade names)] and the like. The numeral in the bracket indicates the average molecular weight of the polyoxyethylene chain.

(2) Alkyl, arylalkyl, alaryl or aryl monoethers of polyoxyethylene glycol (derivatives of polyoxyethylene glycol with one hydroxyl group being etherified):

Those belonging to this cateoory may include, for example, alkyl and alaryl monoether derivatives with an ether residue having 6 or more carbon atoms, preferably 18 to 50 carbon atoms. The alkyl group and the alaryl group may be either straight or branched.

Specific examples may include polyethylene glycol mono-p-nonylphenyl ether, polyethylene glycol monobehenyl ether, polyethylene glycol monooleyl ether and the like.

Further, in the present invention, as a special case, the ether residue may be derived from unsaturated hydrocarbons, synthetic alcohols, oxycarboxylic acids, nitrogen-containing compounds and sulfur-containing compounds.

(3) Ether or ester derivatives of the monoether derivatives shown in the above (2):

That is, they are the above monoether derivatives of polyethylene glycol of which residual hydroxyl group is are further derivatized into ether derivatives or ester derivatives.

In this case, ester derivatives may be obtained similarly as in the case of the above (1), and ether derivatives as in the case of the above (2).

Specific examples may include monobehenate of polyethylene glycol mono-p-nonylphenyl ether [PEG 800], monostearate of polyethylene glycol monostearyl ether [PEG 9000], polyethylene glycol dibehenyl ether [PEG 6000], polyethylene glycol monooleyl ether monobehenyl ether [PEG 4000 (all trade names)] and the like.

(4) Polyoxyethylene glycol ether derivatives of polyhydric alcohols:

As the above polyhydric alcohol, there may be included compounds having 2 or more alcoholic hydroxyl groups in the molecule such as glycerine, propylene glycol, pentaerythritol, polypropylene glycol, sorbitane (1,5-sorbitane, 1,4-sorbitane, 3,6-sorbitane, isosorbite, etc.), mannitol, and otherwise Povals (trade name) with molecular weights ot 800 or less.

Further, the polyhydric alcohol may comprise two or more sets thereof bonded through another molecular chain such as polyoxyethylene chain, etc.

The polyoxyethylene glycol derivative as represented above has a polyoxyethylene glycol bonded through ether linkage to one hydroxyl group of said polyhydric alcohol, but it may also have the residual hydroxyl group of said polyhydric alcohol derivatized into ether according to the above (1) or (2) (this is a polyoxyethylene glycol diether derivative), or the residual hydroxyl group derivatized into ester.

Also, from a different point of view, the polyoxyethylene glycol ether derivative may also have a single or a plural number of polyoxyethylene chain in the molecule. And, the hydroxyl group at the terminal end of the polyoxyethylene chain in the polyoxyethylene glycol ether derivative should desirably be derivatized into ester or ether according to the above (1) or (2).

Specific examples of the polyoxyethylene glycol ether derivatives as represented above are shown below:

polyoxyethylene monostearate of glycerine;

di(polyoxyethylenemonostearate) of glycerine;

polyoxyethylene monobehenate of sorbitane monobehenate;

polyoxyethylene ether of batyl alcohol;

polyoxyethylene monooleate of propylene glycol monooleate;
block copolymer of polypropylene glycol and polyoxyethylene glycol;
polyoxyethylene ether behenate of pentaerythritol distearyl ether;
polyoxyethylene ether of sorbitane ester;
polyoxyethylene ether of pentaerythritol;
polyoxyethylene ether of polyglycerine ester;
polyoxyethylene ether ester of batyl alcohol ester;
polyoxyethylene ether of mannitol ester.

(5) Polyoxyethylene derivatives of molecules having sulfur atom or nitrogen atom:

Specific examples belonging to this category may include alkylthiopolyoxyethylene, polyoxyethylene fatty acid amide, polyoxyethylene alkylamine, etc.

(6) Polyoxyethylene derivatives of polymers or copolymers:

Specific examples belonging to this category may include alkylaryl formaldehyde condensed polyoxyethylene ethers, polyoxyethylene ether esters of copolymers, polyoxyethylene ether derivatives of α-olefin maleic anhydride copolymers, etc.

(7) Block polymers of synthetic polymers such as polyesters or polyurethanes with polyoxyethylene glycols.

(8) Compounds having anionic property:

Such compounds may include, for example, anionic surfactants containing polyoxyethylene such as polyoxyethylene alkyl ether carboxylates, polyoxyethylene aryl ether carboxylates, polyoxyethylene fatty acid ester sulfates, polyoxyethylene alkyl ether sulfates, polyoxyethylene aryl ether carboxylates, polyoxyethylene alkyl ether phosphates, polyoxyethylene aryl ether phosphates, polyoxyethylene alkylamide phosphates, polyoxyethylene arylamide phosphates, poloxyethylene fatty acid ester carboxylates, etc.

(9) Compounds having cationic property:

Such compounds may include, for example, alkyl polyoxyethylene ether ammonium salts, aryl polyoxyethylene ether ammonium salts, polyoxyethylene hydroxyammonium salts, etc.

Having exemplified above various polyoxythylene compounds, such polyoxyethylene compounds are mixed with the above copolymer, the heat-fusible compound and the colorant in the present invention to prepare a colorant layer composition.

During preparation, the polyoxyethylene type compound, depending on its kind, may not be mixed under sufficiently dispersed state in the colorant layer composition. For example, when the polyoxyethylene chain has a large molecular weight greater than 1000, miscibility of the polyoxyethylene compound with the above copolymer or with the heat-fusible substance as described below may be sometimes lowered.

However, for the reason which has not been necessarily clarified, the polyoxyethylene type compound can exhibit the effect of the present invention irrespectively whether it may be in a clearly dispersed state, a pseudomixed state or a mixed state.

Colorant Layer

The colorant layer in the present invention contains a colorant and a heat-fusible substance similarly as in the thermal transfer recording medium of the prior art, but its great specific feature resides in containing the above copolymer and the above polyoxyethylene type compound. Further, when a specific tacky resin is contained as the third component, the effect of the present invention can be highly exhibited.

Examples of the tacky resin as the above third component may include rosins such as gum rosin, tall rosin and wood rosin, etc.; modified rosins obtained by hydrogenation, disproportionation, dimerization, esterification, lime modification and combination thereof; terpene resins, hydrogenation modified terpenes and terpene phenol resins; natural resins such as danmal, coval and shellac; petroleum resins such as aliphatic, aromatic, copolymer type and alicyclic type and coumarone-indene resins; oil-soluble phenol resins such as alkylphenol resins, modified phenol resins, etc.; xylene type resins such as xylene resins and modified xylene resins, etc. Among them, natural resin types such as rosins, modified rosins, terpene resins, hydrogenation modified terpenes and petroleum resins such as C5 type and C9 type are preferred.

Further, among various resins as mentioned above, tacky resins having softening points ranging from 60° C. to 130° C. are preferred.

Heat-fusible Substance

As the above heat-fusible substance, for example, there may be employed the following materials: namely, (1) ester wax (natural ester type wax such as carunauba wax, montan wax, etc., synthetic wax such as Hoechst Wax E, F, KP, KPS, BJ, OP, OM, X22, U and O (all trade names) produced by Hoechst K.K.); (2) oxidized wax (wax obtained by oxidation of paraffin wax, microcrystalline wax, etc., NPS-9210, NPS-6114 produced by Nippon Seiro K.K.; PETRONABA.C, CARDIS 314 produced by Toyo Petrolite K.K.; or Hoechst Wax S.L and LP produced by Hoechst K.K., all trade names); (3) low molecular weight polyethylene wax (particularly POLYWAX 500 and 655 (trade names) produced by Toyo Petrolite K.K. having a molecular weight of 300 to 1000); (4) Paraffin wax (145, 150, 155, HNP-3, HNP-10, etc. (all trade names) produced by Nippon Seiro K.K.); (5) Microwax (Nisseki Microwax 155, 180, etc. produced by Nippon Sekiyu K.K.; HI-MIC-1080, HI-MIC-2065, HI-MIC-2095, HI-MIC-1070, HI-MIC-1045, HI-MIC-2045, etc. produced by Nippon Seiro K.K.; STA WAX 100, BE SQU ARE 175, 185, VICTORY, ULTRAFLEC, etc. produced by Toyo Petrolite; etc. (all trade names)); (6) otherwise higher fatty acids such as stearic acid, myristic acid, behenic acid, margaric acid, etc.; higher alcohols such as stearyl alcohol, behenyl alcohol, marganyl alcohol, myrisyl alcohol, eicosanol, etc.; higher fatty acid esters such as cetyl palmitate, myrisyl palmitate, cetyl stearate, myrisyl stearate, dodecyl stearate, etc.; vegetable waxes such as wood wax, auricuri wax, espal wax, etc.; animal waxes such as beeswax, insect wax, shellac wax, whale wax, etc.; stearon, sorbitane monostearate, polyoxyethylene monostearate, etc. Other than these, olefin polymer waxes comprising copolymers of maleic anhydride with α-olefin such as ethylene, propylene or butene-1 can be also suitably used.

The various heat-fusible substances as mentioned above can be used either alone as a single kind or as a combination of two or more kinds.

Among these various heat-fusible substances, ester wax, paraffin wax, olefin polymer wax are preferred, particularly carunauba wax, paraffin wax and polyethylene wax are preferred.

Colorant

The colorant to be contained in the colorant layer in the present invention can be used as suitably selected from the known dyes in the prior art, and may be suitably selected from among, for example, direct dyes, acidic dyes, basic dyes, disperse dyes, oil-soluble dyes, etc. As the dye to be used in the present invention, any dye which can be transferred (migrated) together with the heat-fusible substance can be used, and therefore pigments other than those mentioned above may be also available.

Specifically, examples of yellow dye may include Kayaron Polyester Light Yellow 5G-S (produced by Nippon Kayaku K.K.), Oil Yellow S-7 (terra abla), Eisenspiron GRH Special (produced by Hodogaya Kagaku K.K.), etc.; examples of red dye may include Diacerintone Fast Red R (produced by Mitsubishi Kasei K.K.), Dianix Brilliant Red BS-E (produced by Mitsubishi Kasei K.K.), Sumiplast Red FB (produced by Sumitomo Kagaku Kogyo K.K.), Sumiplast Red HGF (produced by Sumitomo Kagaku Kogyo K.K.), Kayaron Polyester Pink RCL-E (produced by Nihon Kayaku K.K.), Eisenspiron RED GEH Special (produced by Hodogaya Kagaku K.K.), etc.; examples of blue dye may include Diaceritone Fast Brilliant Blue R (produced by Mitsubishi Kasei K.K.), Dianix Blue EB-E (produced by Mitsubishi Kasei K.K.), Kayaron Polyester Blue B-SF Conc. (produced by Nihon Kayaku K.K.), Sumiplast Blue 3R (produced by Sumitomo Kagaku Kogyo K.K.), Sumiplast Blue G (produced by Sumitomo Kagaku Kogyo K.K.), etc. Also, as yellow pigment, for example, Hanza Yellow 3G (produced by Sumitomo Kagaku Kogyo K.K.), Taltrazine Lake, etc. may be employed; as red pigment, for example, Brilliant Carmine FB-Pure (produced by Sanyo Shikiso K.K.), Brilliant Carmine 6B (produced by Sanyo Shikiso K.K.), Alizarine Lake, etc. may be employed; as blue pigment, for example, Cerlean Blue, Sumika Print Cyanine Blue GN-O (produced by Sumitomo Kagaku Kogyo K.K.), Phthalocyanine Blue, etc. may be employed; and as black pigment, Carbon Black, Oil Black, etc. may be employed (all trade names).

Additive

In the colorant layer in the present invention, various additives other than the above components may be also formulated, provided that they do not interfere with the objects of the present invention.

As such additives, for example, vegetable oils such as castor oil, linseed oil, olive oil, etc. and animal oils such as whale oils can be suitably used as the softening agent.

Formulation of Respective Components

The composition ratios of the above copolymer, the polyoxyethylene type compound, the heat-fusible substance, the colorant and, if necessary, the tacky resin as the third component for forming the colorant layer in the present invention is not limitative. In usual cases, the amount of the above copolymer formulated may be 5 to 40%, the amount of the polyoxyethylene type copolymer formulated 0.5 to 20%, preferably 1 to 10%, based on the total amount of the colorant layer. On the other hand, when a tacky resin which is the third component is formulated, its formulation ratio may be 0.5 to 20%, preferably 3 to 15% based on the total amount of the colorant layer. As the heat-fusible substance, it may be 5 to 90 parts, preferably 10 to 80 parts based on 100 parts by weight of the total amount of the colorant layer (hereinafter "parts by weight" are abbreviated as "parts"), and the above colorant may be 5 to 40 parts, preferably 10 to 20 parts.

Formulation of the above copolymer, the polyoxyethylene type compound, the heat-fusible substance, the colorant and, if necessary, the tacky resin which is the third component can be performed according to a method known in the art, for example, according to the method in which the above respective components are mixed at once.

For obtaining a colorant layer composition in which the respective components of the above copolymer, the above polyoxyethylene type compound, etc. are thoroughly mixed, the respective components as mentioned above may be preferably mixed by means of a dispersing machine such as dissolver, mixer, sand grinder, ball mill, etc. The dispersed particle size by means of these dispersing machines may be preferably made 10 μm or less.

The dispersed state can be easily examined by observation of the colorant composition from which the colorant is removed under the hot melt state or the coated state. By this observation, when formation of sea-island texture, white turbidity or liquid droplet (oil droplet) state, formation of phase separation is observed, it can be judged as unmixed stated.

Support (Substrate)

The support as the substrate to be used in the thermal transfer recording medium according to the present invention should preferably have heat-resistant strength, dimentional stability and high surface smoothness. To add further, the support should desirably have heat-resistant strength to the extent that no softening or plasticization is effected by heating with a heating source such as thermal head, etc., and also provided with mechanical strength and dimensional stability as the support and also with sufficient smoothness for the colorant layer on the support to exhibit good transfer ratio.

As the above smoothness, it may be preferably 100 seconds or more as measured by smoothness test with a Bekk testing machine (JKS P 8119), and if it is 300 seconds or more, printed image with reproducibility can be obtained with better transfer ratio.

Examples of the material for support having preferable properties as mentioned above may include various papers such as plain paper, condenser paper, laminated paper, and coated paper, etc.; sheets or films of thermoplastic resins such as polyethylene, polypropylene, polyethylene terephthalate, polystyrene, polyimide, polyamide (Nylon, trade name), etc.; composites of the above papers with the above thermoplastic resin films or sheets; metal sheets such as metal foils of aluminum, etc., as preferable ones.

The thickness of the support may be qenerally about 60 μm or less for obtaining good thermal conductivity, particularly preferably 2 to 20 μm. The constitution of the back surface of the thermal transfer recording medium according to the present invention may have any desired constitution. Thus, the back surface of the support may be coated with a sticking layer, if necessary.

Formation of Colorant Layer onto Support

Since preferable techniques for formation of the colorant layer onto the surface of the above support are known in this field of art, the colorant layer can be formed on the surface of the support by use of such known techniques also for the thermal transfer recording medium according to the present invention.

For example, the colorant layer can be formed by hot melt coating of its composition, or alternatively by solvent coating of a coating liquid in which its composition is dispersed or dissolved in a suitable solvent. As the coating method, there may be employed, for example, the reverse roll coater method, the extrusion coater method, the gravure coater method, the wire bar coater method, or any other desired technique. The thickness of the colorant layer may be generally 15 μm, preferably 1 to 9 μm.

The thermal transfer recording medium thus obtained has a strength at break of 30 kg/cm$^2$, particularly 45 kg/cm$^2$ or higher, an elongation at break of 2% or longer, particularly 5% or longer, and can effect sharp printing thereon.

According to the present invention, since a special copolymer is contained in the colorant layer in a thermal transfer recording medium having a colorant layer containing a heat-fusible substance and a colorant formed on the surface of a support, there can be provided a thermal transfer recording medium capable of transferring printed image of high resolving power with high transfer sensitivity and yet with low energy as well as good fixability, while suppressing further generation of fog, not only on a plain paper with smooth surface, as a matter of course, but also on a surface with low smoothness.

Further, according to the present invention, since a special copolymer and a polyoxyethylene type compound are contained in the colorant layer of a thermal transfer recording medium having a colorant layer containing a heat-fusible substance and a colorant formed on the surface of a support, the load applied to the printer side can be alleviated by lowering the wind-up torque.

EXAMPLES

The present invention is described below by referring to the Examples, by which the present invention is not limited at all. In the following description, all "parts" means "parts by weight".

EXAMPLE 1

A colorant layer composition having the composition shown below was applied onto the surface of a polyethylene terephthalate support with a thickness of 3.5 μm to a dried film thickness of 6.5 μm to obtain a heat-sensitive transfer recording medium sample (A) according to the present invention.

When printing was effected on a plain paper by use of the heat-sensitive transfer recording medium (A) by means of a thermal printer (trially made machine mounted with a thin film type line thermal head with a heat generating element density of 8 dots/mm), the results shown in Table 1 were obtained.

| Colorant layer composition (a): | |
|---|---|
| Carunauba wax (No. 1, produced by Brazil) | 10 parts |
| Paraffin wax ("HNP-3", trade name, produced by Nippon Seiro K.K.) | 48 parts |
| Ethylene-ethyl acrylate-maleic anhydride copolymer ("HZ-8140", trade name, | 15 parts |

-continued

| Colorant layer composition (a): | |
|---|---|
| produced by Sumitomo CDF K.K.) | |
| Carbon Black | 14 parts |
| Polyethylene wax ("PW-500", trade name, produced by Valeco K.K.) | 13 parts |

EXAMPLE 2

A thermal transfer recording medium (B) was obtained in the same manner as in Example 1 except for using the colorant layer composition (b) shown below in place of the colorant layer composition (a).

For the thermal transfer recording medium (B), printing performance was evaluated similarly as in the above Example 1. The results are shown in Table 1.

| Colorant layer composition (b): | |
|---|---|
| Carunauba wax (No. 1, produced by Brazil) | 5 parts |
| Paraffin wax ("HNP-10", trade name, produced by Nippon Seiro K.K.) | 48.5 parts |
| Ethylene-butyl acrylate-maleic anhydride copolymer ("AX-8140", trade name, produced by Sumitomo CDF K.K.) | 12.5 parts |
| Terpene resin ("YS resin PX800", produced by Yasuhara Yushi K.K.) | 10 parts |
| Carbon Black | 14 parts |
| Diacaruna 30 (trade name, produced by Mitsubishi Kasei K.K.) | 10 parts |

EXAMPLE 3

A thermal transfer recording medium (C) was obtained in the same manner as in the above Example 1 except for using a hydrogenated rosin in place of the polyethylene wax in the colorant layer composition (a).

For the thermal transfer recording medium (C), printing was effected on a plain paper similarly as in the above Example 1 for evaluation of its performance. The results are shown in Table 1.

COMPARATIVE EXAMPLE 1

A heat-sensitive transfer recording medium (D) was obtained in the same manner as in the above Example 1 except for using a conventional ethylene-vinyl acetate copolymer [polymerization ratio (ethylene monomer units)/vinyl acetate monomer units=75/25] in place of the ethylene-ethyl acrylate-maleic anhydride copolymer in the colorant layer composition (a).

For the heat-sensitive transfer recording medium (D), its printing performance was evaluated similarly as in the above Examples. The results are shown in Table 1.

TABLE 1

| | Transfer sensitivity (mJ/dot) *1 | Contamination on the ground portion *2 | Fixability to the plain paper *3 | Resolving power *4 |
|---|---|---|---|---|
| Example 1 | 0.42 | ⊙ | ○ | ⊙ |
| Example 2 | 0.55 | ⊙ | ⊙ | ⊙ |
| Example 3 | 0.56 | ⊙ | ⊙ | ○ |
| Compara- | 0.66 | ○ | ○ | X |

TABLE 1-continued tive example 1

*1: Printing was effected on a plain paper by the above thermal printe by varying the applied energy from 0 to 0.6 mJ/dot at intervals of 0.03 mJ/dot, and the density of the printed dye transfer image was measured by an optical reflective densitometer [produced by Konishiroku Photo Industry Co., Ltd.). The applied energy necessary to obtain a dye transfer image with 0.9-fold of the maximum optical reflective density was determined from the graph and defined as the transfer sensitivity.
*2: Various Chinese characters were printed on a low smoothness paper with Bekk smoothness of 10 seconds, and contamination on the portions other than the printed portion was observed with a magnifier and evaluated. The symbols and the contents of observation evaluation meant thereby in Table 1 are shown below:
◎ . . . no contamination at all.
O . . . slight contamination occurred.
X . . . marked contamination occurred
*3: rubbed with ordinary force by a plastic eraser rubber for 5 times, and the contaminated state on the paper surface thereafter was observed and evaluated. The symbols and the contents of observation evaluation meant thereby in Table 1 are shown below:
◎ . . . the portions other than the printed portion are thinly contaminated.
O . . . printing is readable, but the portions other than the printed portion are also contaminated to the same extent as the printed portion.
X . . . the printed portion is markedly contaminated and the printing is sometimes unreadable.
*4: printing was effected in check pattern on a low smoothness paper with Bekk smoothness of 10 seconds and observed with a magnifier and evaluated. The symbols and the contents of observation evaluation meant thereby in Table 1 are shown below:
◎ . . . edges of printing are sharp.
O . . . slight disintegration occurred at edges of printing.
X . . . defect and unfocused portion occurred in printing.

As is apparent from Table 1, it can be understood that the thermal transfer recording medium samples according to the present invention are all capable of low energy printing, and can also further prevent ground contamination (fog) on low smoothness paper, whereby dye transfer images of high resolving power with good fixability can be obtained.

EXAMPLE 4

A colorant layer composition having a composition comprising 15% carbon black, 4% polyethylene glycol monobehenyl ether (PEG, n=10) as the polyoxyethylene compound, 40% paraffin wax (melting point: 68° C.), 11% polyethylene wax (melting point: 64° C.), 15% BONDINE HX-8140 [trade name, produced by Sumito CDF K.K.] as the ethylene-acrylic acid derivative-maleic anhydride copolymer and 15% Diacaruna 30 [trade name, produced by Mitsubishi Kasei K.K.] was applied on the surface of a polyethylene terephthalate film support with a thickness of 3.5 μm to a dried thickness of 5.0 μm to obtain a thermal transfer recording medium sample.

For the thermal transfer recording medium sample, printing was effected on a low smoothness paper with Bekk smoothness of 10 seconds by a thermal printer (trially made machine mounted with a thin film type line thermal head with a heat generating element density of 8 dots/mm) under printing pressures of 400 g/head and 600 g/head. And, contamination at the portions other than the printed portion was observed with a magnifier to find that there was no contamination at all.

EXAMPLE 5

A colorant layer composition having a composition comprising 15% carbon black, 10% polyethylene glycol distearate (Mw=400) as the polyoxyethylene type compound, 8% ester wax, 45% paraffin wax, 10% terpene resin and 12% BONDINE HX-8140 [trade name, produced by Sumitomo CDF K.K.] as the ethylene-acrylic acid derivative-maleic anhydride copolymer was applied onto the surface of a polyethylene terephthalate film support with a thickness of 3.5 μm to a dried film thickness of 5.0 μm to obtain a thermal transfer recording medium sample.

For the thermal transfer recording medium, similarly as described in the above Example 4, printing was effected under a printing pressure of 400 g/head. And, the contamination at the portions other than the printed portions was observed with a magnifier to find that there was no contamination at all.

EXAMPLES 6 TO 14

A colorant layer composition having a composition comprising 15% carbon black, 10% of the polyoxyethylene type compound shown in Table 1, 8% ester wax, 45% paraffin, 10% terpene resin and 12% BONDINE HX-8040 [trade name, produced by Sumitomo CDF Co.] as the ethyl-ene-acrylic acid derivative-maleic anhydride copolymer was applied onto the surface of a polyethylene terephthalate support with a thickness of 3.5 μm to a dried film thickness of 5.0 μm to obtain a heat-sensitive transfer recording medium.

For the 9 kinds of heat-sensitive transfer recording media thus obtained, by use of the same thermal printer as used in the above Example 4, printing was effected in check pattern on a low smoothness paper with Bekk smoothness of 10 seconds under a printing pressure of 300 g/head, and its printing quality was observed and evaluated by observation with a magnifier. The results are shown in Table 2. The symbols in Table 2 indicate the evaluation contents as shown below:

◎ . . . edges or printing are sharp.
O . . . slight disintegration occurred at edges of printing.
X . . . defect and unfocusted portion occurred in printing.

Further, for the heat-sensitive transfer recording media according to Examples 6 and 7, ink elongation at break and ink strength at break were measured according to ASTM D 638.

The results are shown in Table 3.

EXAMPLE 15

A heat-sensitive transfer recording medium was obtained by practicing the foregoing Example 7 except that the amount of the ester wax formulated was made zero and the ratio of BONDINE HX-8040 [trade name, produced by Sumitomo CDF Co.] was changed to 20%.

For the heat-sensitive transfer recording medium, printing quality was evaluated similarly as in the foregoing Example. The results are shown in Table 2.

For the heat-sensitive transfer recording medium, ink elongation at break and ink strength at break were measured similarly as in Examples 6 and 7.

The results are shown in Table 3.

EXAMPLE 16

A heat-sensitive transfer recording medium was obtained by practicing the foregoing Example 6 except that the amount of the ester wax was changed to 17% and the formulated ratio of BONDINE HX-8040 [trade name, produced by Sumitomo CDF Co.] was changed to 3%.

For the heat-sensitive transfer recording medium, printing quality was evaluated similarly as in the foregoing Example. The results are shown in Table 2.

For the heat-sensitive transfer recording medium, ink elongation at break and ink strength at break were measured similarly as in Examples 6 and 7.

The results are shown in Table 3.

COMPARATIVE EXAMPLES 2 TO 4

Heat-sensitive transfer recording media samples were prepared in the same manner as in Example 6 except for formulating the compounds shown in Table 2 in place of the polyoxyethylene type compound, and printing quality was evaluated similarly as in the above Example. The results are shown in Table 2.

TABLE 2

| | Kinds of polyoxyethylene type compound (other compounds in Comparative example) | Printing quality |
|---|---|---|
| Example 6 | Polyethylene glycol distearate (Mw = 400) | ◎ |
| Example 7 | Polyethylene glycol catearylether (Mw = 200) | ◎ |
| Example 8 | Polyoxyethylene ether of sorbitane beeswax (Mw = 200) | ◎ |
| Example 9 | Polyethylene glycol monocetyl ester (Mw = 9000) | ○ |
| Example 10 | Polyethylene glycol monostearate (Mw = 4000) | ○ |
| Example 11 | Copolymer of polypropylene glycol (Mw = 4000) and polyethylene glycol (Mw = 4000) | ○ |
| Example 12 | Monobehenate of polyethylene glycol.mono.p-nonylphenyl ether (Mw = 800) | ○ |
| Example 13 | Polyethylene glycol ether of pentaerythritol (Mw = 400) | ○ |
| Example 14 | Stearylthiopolyethylene glycol ether | ○ |
| Example 15 | Polyethylene glycol distearate (Mw = 400) [BONDINE HX-8040; 20%, ester wax; 0 %] | ○ ○ |
| Example 16 | Polyethylene glycol distearate (Mw = 400) [BONDINE HX-8040; 3 %; ester wax; 17 %] | ○ ○ |
| Comparative example 2 | Paraffin wax | X |
| Comparative example 3 | Glycerine monostearate | X |
| Comparative example 4 | Pentaerythritol | X |

TABLE 3

| | Ink strength at break ($kg/cm^2$) | Ink elongation at break (%) |
|---|---|---|
| Example 6 | 51 | 5 |
| Example 7 | 48 | 7 |
| Example 15 | 124 | 5 |
| Example 16 | 31 | 2 |

As is apparent from Table 2 and Table 3, it can be understood that the heat-sensitive transfer recording medium samples according to the present invention all have no ground contamination also on low smoothness paper and can effect printing of high quality.

We claim:

1. A thermal transfer recording medium having a colorant layer formed on a support, said colorant layer containing a heat-fusible substance, a colorant, and a copolymer, said copolymer obtained from an ethylene, an acrylic acid derivative represented by the formula (I):

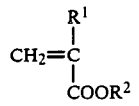

(I)

wherein $R^1$ represents a hydogen atom or a methyl group and $R^2$ represents a straight or branched alkyl group having 1 to 8 carbon atoms, and a maleic anhydride.

2. The thermal transfer recording medium according to claim 1, wherein said copolymer is represented by the formula (II):

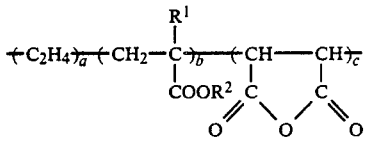

(II)

wherein $R^1$ represents a hydrogen atom or a methyl group, $R^2$ represents a straight or branched alkyl group having 1 to 8 carbon atoms, a, b and c are copolymerization ratios, with a being 50 to 90%, b being 10 to 50% and c being 0.5 to 15%, when a+b+c=100%.

3. The thermal transfer recording medium according to claim 2, wherein a is 62 to 79%, b is 20 to 35% and c is 0.5 to 10%.

4. The thermal transfer recording medium according to claim 2, wherein $R^2$ is an ethyl group.

5. The thermal transfer recording medium according to claim 1, wherein said copolymer has a melt flow index (MI) during melting of 1 to 400 g/10 min.

6. The thermal transfer recording medium according to claim 1, wherein said copolymer has a melt flow index (MI) during melting of 1 to 50 g/10 min.

7. The thermal transfer recording medium according to claim 1, wherein said copolymer has a melt flow index (MI) during melting of 1.5 to 40 g/10 min.

8. The thermal transfer recording medium according to claim 1, wherein said colorant layer contains a polyoxyethylene type compound.

9. The thermal transfer recording medium according to claim 8, wherein said copolymer is represented by the formula (II):

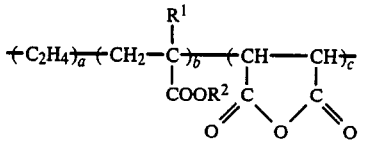

(II)

wherein $R^1$ represents a hydrogen atom or a methyl group, $R^2$ represents a straight or branched alkyl group having 1 to 8 carbon atoms, a, b and c are copolymerization ratios, with a being 50 to 90%, b being 10 to 50% and c being 0.5 to 15%, when a+b+c=100%.

10. The thermal transfer recording medium according to claim 9, wherein a is 62 to 79%, b is 20 to 35% and c is 0.5 to 10%.

11. The thermal transfer recording medium according to claim 9, wherein $R^2$ is an ethyl group.

12. The thermal transfer recording medium according to claim 8, wherein said copolymer has a melt flow index (MI) during melting of 1 to 400 g/10 min.

13. The thermal transfer recording medium according to claim 8, wherein said copolymer has a melt flow index (MI) during melting of 1 to 50 g/10 min.

14. The thermal transfer recording medium according to claim 8, wherein said copolymer has a melt flow index (MI) during melting of 1.5 to 40 g/10 min.

* * * * *